US010869497B2

(12) United States Patent
Nordskog

(10) Patent No.: US 10,869,497 B2
(45) Date of Patent: Dec. 22, 2020

(54) HIGH-PRESSURE COLD PASTEURIZATION OF TOBACCO MATERIAL

(71) Applicant: R.J. Reynolds Tobacco Company, Winston-Salem, NC (US)

(72) Inventor: Brian Keith Nordskog, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 869 days.

(21) Appl. No.: 14/847,485

(22) Filed: Sep. 8, 2015

(65) Prior Publication Data

US 2017/0064993 A1 Mar. 9, 2017

(51) Int. Cl.

| | |
|---|---|
| ***A24B 13/00*** | (2006.01) |
| ***A24B 15/18*** | (2006.01) |
| ***A24B 15/167*** | (2020.01) |

(52) U.S. Cl.

CPC ..... *A24B 13/00* (2013.01); *A24B 15/167* (2016.11); *A24B 15/183* (2013.01)

(58) Field of Classification Search

None

See application file for complete search history.

(56) References Cited

U.S. PATENT DOCUMENTS

| | | | |
|---|---|---|---|
| 1,376,586 | A | 5/1921 | Schwartz |
| 3,696,917 | A | 10/1972 | Levi |
| 4,144,895 | A | 3/1979 | Fiore |
| 4,150,677 | A | 4/1979 | Osborne, Jr. et al. |
| 4,267,847 | A | 5/1981 | Reid |
| 4,289,147 | A | 9/1981 | Wildman et al. |
| 4,351,346 | A | 9/1982 | Brummer et al. |

(Continued)

FOREIGN PATENT DOCUMENTS

| | | |
|---|---|---|
| CN | 1593270 A | 3/2005 |
| EP | 0 404 475 | 12/1990 |

(Continued)

OTHER PUBLICATIONS

American Public Health Association. *Compendium of Methods for the Microbiological Examination of Foods*. APHA, Washington D.C., 1984, 2nd Edition, Chapter 4, pp. 62-83.

(Continued)

*Primary Examiner* — Michael J Felton

(74) *Attorney, Agent, or Firm* — Womble Bond Dickinson (US) LLP

(57) ABSTRACT

A tobacco material having at least about 40% water based on the total weight, and having a storage stability of at least about 25 days is provided herein, wherein the storage stability is defined as an aerobic plate count below about 3,000,000 CFU/g. A method of treating a tobacco material to enhance storage stability is also provided herein, the method including receiving a tobacco material having at least about 40% water based on the total weight and subjecting the tobacco material to a process pressure of at least about 30,000 psi to form a high pressure processed tobacco material, wherein the high pressure processed tobacco material has a storage stability of at least about 25 days, and wherein the storage stability is defined as an aerobic plate count below about 3,000,000 CFU/g.

11 Claims, 4 Drawing Sheets

(56) References Cited

U.S. PATENT DOCUMENTS

| | | | | |
|---|---|---|---|---|
| 4,359,059 | A | 11/1982 | Brummer et al. | |
| 4,506,682 | A | 3/1985 | Muller | |
| 4,513,756 | A | 4/1985 | Pittman et al. | |
| 4,528,993 | A | 7/1985 | Sensabaugh, Jr. et al. | |
| 4,589,428 | A | 5/1986 | Keritsis | |
| 4,605,016 | A | 8/1986 | Soga et al. | |
| 4,624,269 | A | 11/1986 | Story et al. | |
| 4,716,911 | A | 1/1988 | Poulose et al. | |
| 4,727,889 | A | 3/1988 | Niven, Jr. et al. | |
| 4,887,618 | A | 12/1989 | Bernasek et al. | |
| 4,941,484 | A | 7/1990 | Clapp et al. | |
| 4,967,771 | A | 11/1990 | Fagg et al. | |
| 4,986,286 | A | 1/1991 | Roberts et al. | |
| 4,987,907 | A | 1/1991 | Townend | |
| 4,991,599 | A | 2/1991 | Tibbetts | |
| 5,005,593 | A | 4/1991 | Fagg | |
| 5,018,540 | A | 5/1991 | Grubbs et al. | |
| 5,060,669 | A | 10/1991 | White et al. | |
| 5,065,775 | A | 11/1991 | Fagg | |
| 5,074,319 | A | 12/1991 | White et al. | |
| 5,092,352 | A | 3/1992 | Sprinkle, III et al. | |
| 5,099,862 | A | 3/1992 | White et al. | |
| 5,121,757 | A | 6/1992 | White et al. | |
| 5,131,414 | A | 7/1992 | Fagg et al. | |
| 5,131,415 | A | 7/1992 | Munoz et al. | |
| 5,148,819 | A | 9/1992 | Fagg | |
| 5,197,494 | A | 3/1993 | Kramer | |
| 5,230,354 | A | 7/1993 | Smith et al. | |
| 5,234,008 | A | 8/1993 | Fagg | |
| 5,243,999 | A | 9/1993 | Smith | |
| 5,301,694 | A | 4/1994 | Raymond et al. | |
| 5,316,745 | A * | 5/1994 | Ting | A23L 3/0155 422/295 |
| 5,318,050 | A | 6/1994 | Gonzalez-Parra et al. | |
| 5,343,879 | A | 9/1994 | Teague | |
| 5,360,022 | A | 11/1994 | Newton et al. | |
| 5,387,416 | A | 2/1995 | White et al. | |
| 5,435,325 | A | 7/1995 | Clapp et al. | |
| 5,445,169 | A | 8/1995 | Brinkley et al. | |
| 5,622,678 | A * | 4/1997 | Hiltawsky | A61L 2/02 422/292 |
| 6,131,584 | A | 10/2000 | Lauterbach | |
| 6,284,875 | B1 | 9/2001 | Turpen et al. | |
| 6,298,859 | B1 | 10/2001 | Kierulff et al. | |
| 6,322,837 | B1 | 11/2001 | Nakayama | |
| 6,668,839 | B2 | 12/2003 | Williams | |
| 6,772,767 | B2 | 8/2004 | Mua et al. | |
| 6,817,970 | B2 | 11/2004 | Berit et al. | |
| 6,834,564 | B2 | 12/2004 | Huesges et al. | |
| 6,906,172 | B2 | 6/2005 | Bratcher et al. | |
| 6,953,040 | B2 | 10/2005 | Atchley et al. | |
| 7,032,601 | B2 | 4/2006 | Atchley et al. | |
| 7,034,128 | B2 | 4/2006 | Turpen et al. | |
| 7,048,211 | B2 | 5/2006 | Bratcher et al. | |
| 7,220,381 | B2 * | 5/2007 | Ting | A23L 3/0155 422/1 |
| 7,337,782 | B2 | 3/2008 | Thompson | |
| 7,694,686 | B2 | 4/2010 | Atchley et al. | |
| 8,507,020 | B2 | 8/2013 | DesLauriers et al. | |
| 9,039,839 | B2 * | 5/2015 | Beeson | A24B 13/00 131/119 |
| 2004/0020503 | A1 | 2/2004 | Williams | |
| 2004/0045450 | A1 | 3/2004 | Hernando | |
| 2005/0115580 | A1 | 6/2005 | Quinter et al. | |
| 2005/0244521 | A1 | 11/2005 | Strickland et al. | |
| 2006/0099306 | A1 | 5/2006 | Miller | |
| 2006/0191548 | A1 | 8/2006 | Strickland et al. | |
| 2007/0062549 | A1 | 3/2007 | Holton, Jr. et al. | |
| 2007/0186941 | A1 | 8/2007 | Holton, Jr. et al. | |
| 2007/0186942 | A1 | 8/2007 | Strickland et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0209586 | A1 | 8/2008 | Nielsen et al. | |
| 2008/0305216 | A1 | 12/2008 | Crawford et al. | |
| 2008/0311259 | A1 | 12/2008 | Singh et al. | |
| 2009/0025738 | A1 | 1/2009 | Mua et al. | |
| 2009/0025739 | A1 | 1/2009 | Brinkley et al. | |
| 2009/0065013 | A1 | 3/2009 | Essen et al. | |
| 2009/0293889 | A1 | 12/2009 | Kumar et al. | |
| 2010/0018540 | A1 | 1/2010 | Doolittle et al. | |
| 2010/0018541 | A1 | 1/2010 | Gerardi et al. | |
| 2010/0291245 | A1 | 11/2010 | Gao et al. | |
| 2011/0139164 | A1 | 6/2011 | Mua et al. | |
| 2011/0174323 | A1 | 7/2011 | Coleman, III et al. | |
| 2011/0247640 | A1 | 10/2011 | Beeson et al. | |
| 2011/0259353 | A1 | 10/2011 | Coleman, III et al. | |
| 2012/0037175 | A1 | 2/2012 | Cantrell et al. | |
| 2012/0055494 | A1 | 3/2012 | Hunt et al. | |
| 2012/0103353 | A1 | 5/2012 | Sebastian et al. | |
| 2012/0125354 | A1 | 5/2012 | Byrd et al. | |
| 2012/0138073 | A1 | 6/2012 | Cantrell et al. | |
| 2012/0138074 | A1 | 6/2012 | Cantrell et al. | |
| 2013/0074855 | A1 | 3/2013 | Holton, Jr. | |
| 2013/0074856 | A1 | 3/2013 | Holton, Jr. | |

FOREIGN PATENT DOCUMENTS

| | | |
|---|---|---|
| EP | 1 201 252 | 5/2002 |
| JP | 3028340 | 4/2000 |
| WO | WO 2004/095959 | 11/2004 |
| WO | WO 2005/004480 | 1/2005 |
| WO | WO 2005/016036 | 2/2005 |
| WO | WO 2005/041699 | 5/2005 |
| WO | WO 2005/063060 | 7/2005 |
| WO | WO 2007/138484 | 12/2007 |
| WO | WO 2010/132444 | 11/2010 |

OTHER PUBLICATIONS

Association of Official Analytical Chemists. *Official Methods of Analysis*. AOAC, Arlington, VA, 1990, 15th Edition.

Balasubramaniam, V. M. and Farkas, D., "High-Pressure Food Processing," *Food Science Technology Int*., 2008, pp. 413-418, vol. 14(5).

Balda, F. P., et al., "Industrial High Pressure Processing of Foods: Review of Evolution and Emerging Trends," *Journal of Food Science and Engineering*, 2012, pp. 543-549, vol. 2.

Daryaei, H., et al., "Lethality enhancement of pressure-assisted thermal processing against Bacillus amyloliquefaciens spores in low-acid media using antimicrobial compounds," *Food Control*, 2016, vol. 59, pp. 234-242.

"HPP Technology." *Hiperbaric High Pressure Processing*. http://www.hiperbaric.com/en/high-pressure.

"Kinetics of Microbial Inactivation for Alternative Food Processing Technologies—High Pressure Processing." *U.S. Food & Drug Administration*. Last Updated Dec. 18, 2014. http://www.fda.gov/Food/FoodScienceResearch/SafePracticesforFoodProcesses/ucm101456.

Maturin, L. and Peeler, J. T. "BAM: Aerobic Plate Count." *U.S. Food & Drug Administration*. Jan. 2001. http://www.fda.gov/Food/FoodScienceResearch/LaboratoryMethods/ucm063346.

* cited by examiner

HIGH-PRESSURE COLD PASTEURIZATION OF TOBACCO MATERIAL

FIELD OF THE INVENTION

The present invention relates to products made or derived from tobacco, or that otherwise incorporate tobacco or components of tobacco.

BACKGROUND OF THE INVENTION

Cigarettes, cigars, and pipes are popular smoking articles that employ tobacco in various forms. Such smoking articles are employed by heating or burning tobacco to generate aerosol (e.g., smoke) that may be inhaled by the smoker. Popular smoking articles, such as cigarettes, have a substantially cylindrical rod shaped structure and include a charge, roll or column of smokable material such as shredded tobacco (e.g., in cut filler Rum) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999).

Tobacco also may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0025738 to Mua et al.; 2009/0025739 to Brinkley et al.; 2009/0065013 to Essen et al.; 2009/0293889 to Kumar et al.; 2010/0018540 to Doolittle et al; 2010/0018541 to Gerardi et al.; 2010/0291245 to Gao et al; 2011/0139164 to Mua et al.; 2011/0174323 to Coleman, III et al.; 2011/0247640 to Beeson et al.; 2011/0259353 to Coleman, III et al.; 2012/0037175 to Cantrell et al.; 2012/0055494 to Hunt et al.; 2012/0103353 to Sebastian et al.; 2012/0125354 to Byrd et al.; 2012/0138073 to Cantrell et al.; and 2012/0138074 to Cantrell et al; PCT WO 04/095959 to Arnarp et al.; PCT WO 05/063060 to Atchley et al.; PCT WO 05/004480 to Engstrom; PCT WO 05/016036 to Bjorkholm; PCT WO 05/041699 to Quinter et al., and PCT WO 10/132444 to Atchley; each of which is incorporated herein by reference.

One type of smokeless tobacco product is referred to as "snuff." Representative types of moist snuff products, commonly referred to as "snus," have been manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. have been marketed under the tradenames Camel Snus Frost, Camel Snus Original and Camel Snus Spice by R. J. Reynolds Tobacco Company. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard. Representative smokeless tobacco products also have been marketed under the tradenames Oliver Twist by House of Oliver Twist A/S; Copenhagen moist tobacco, Copenhagen pouches, Skoal Bandits, Skoal Pouches, SkoalDry, Rooster, Red Seal long cut, Husky, and Revel Mint Tobacco Packs by U.S. Smokeless Tobacco Co.; Marlboro Snus and "taboka" by Philip Morris USA; Levi Garrett, Peachy, Taylor's Pride, Kodiak, Hawken Wintergreen, Grizzly, Dental, Kentucky King, and Mammoth Cave by American Snuff Company, LLC; Camel Snus, Camel Orbs, Camel Sticks, and Camel Strips by R. J. Reynolds Tobacco Company. Other exemplary smokeless tobacco products that have been marketed include those referred to as Kayak moist snuff and Chatanooga Chew chewing tobacco by Swisher International, Inc.; and Redman chewing tobacco by Pinkerton Tobacco Co. LP.

Various treatment methods and additives have been proposed for altering the overall character or nature of tobacco materials utilized in tobacco products. For example, additives or treatment processes have been utilized in order to alter the chemistry or sensory properties of the tobacco material, or in the case of smokable tobacco materials, to alter the chemistry or sensory properties of mainstream smoke generated by smoking articles including the tobacco material. See, for example, Leffingwell et al., *Tobacco Flavoring for Smoking Products*, R. J. Reynolds Tobacco Company (1972), which is incorporated herein by reference. In addition, tobacco materials have been processed or blended in a manner designed to achieve certain sensory or chemistry characteristics. See, for example, U.S. Pat. No.

7,025,066 to Lawson et al. and US Pat. Pub. No. 2008/0245377 to Marshall et al., which are incorporated herein by reference.

It would be desirable to extend the shelf life of tobacco materials. In particular, it would be advantageous to develop tobacco materials having a storage stability for an increased number of days.

SUMMARY OF THE INVENTION

The present invention provides a method of treating a tobacco material to enhance storage stability, comprising receiving a tobacco material having at least about 40% water based on the total weight, and subjecting the tobacco material to a process pressure of at least about 30,000 psi to form a high pressure processed tobacco material, wherein the high pressure processed tobacco material has a storage stability of at least about 25 days, wherein the storage stability is defined as an aerobic plate count below about 3,000,000 CFU/g. In some embodiments, the tobacco material can be in the form of a particulate material. In certain embodiments, the tobacco material can be in the form of an aqueous tobacco extract.

In various embodiments, the high pressure processed tobacco material can be stored at about 37° C. In some embodiments, the high pressure tobacco material can be refrigerated to increase storage stability. For example, the high pressure processed tobacco material can be stored at about 4° C. The storage stability of the refrigerated tobacco material can be at least about 75 days, or at least about 100 days.

In various embodiments of the method described herein, the process pressure can be at least about 75,000 psi. In some embodiments, the tobacco material can be subjected to the process pressure for a holding time of at least about 30 seconds. For example, the holding time can be in the range of about 180 seconds to about 300 seconds.

In some embodiments, the method can further comprise incorporating the high pressure processed tobacco material into a tobacco product. The tobacco product can be a smoking article, for example. In some embodiments, the tobacco product can be a smokeless tobacco product.

The present invention further provides a tobacco material having at least about 40% water based on the total weight, and having a storage stability of at least about 25 days, wherein the storage stability is defined as an aerobic plate count below about 3,000,000 CFU/g. In various embodiments, the tobacco material can be stored at ambient temperature (e.g., at about 37° C.). In some embodiments, the tobacco material can be refrigerated (e.g., stored at about 4° C.), which can further enhance the storage stability of the tobacco material. For example, the storage stability of the refrigerated tobacco material can be at least about 75 days, or at least about 100 days. In certain embodiments, the tobacco material can be in the form of a particulate material. In some embodiments, the tobacco material can be in the form of an aqueous extract.

The present invention also provides a tobacco product incorporating the tobacco materials having enhanced storage lives that are discussed herein. In some embodiments, the a smoking article. In certain embodiments, the tobacco product can be a smokeless tobacco product.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

In order to provide an understanding of embodiments of the invention, reference is made to the appended drawings, which are not necessarily drawn to scale, and in which reference numerals refer to components of exemplary embodiments of the invention. The drawings are exemplary only, and should not be construed as limiting the invention.

DETAILED DESCRIPTION

Figure 1:
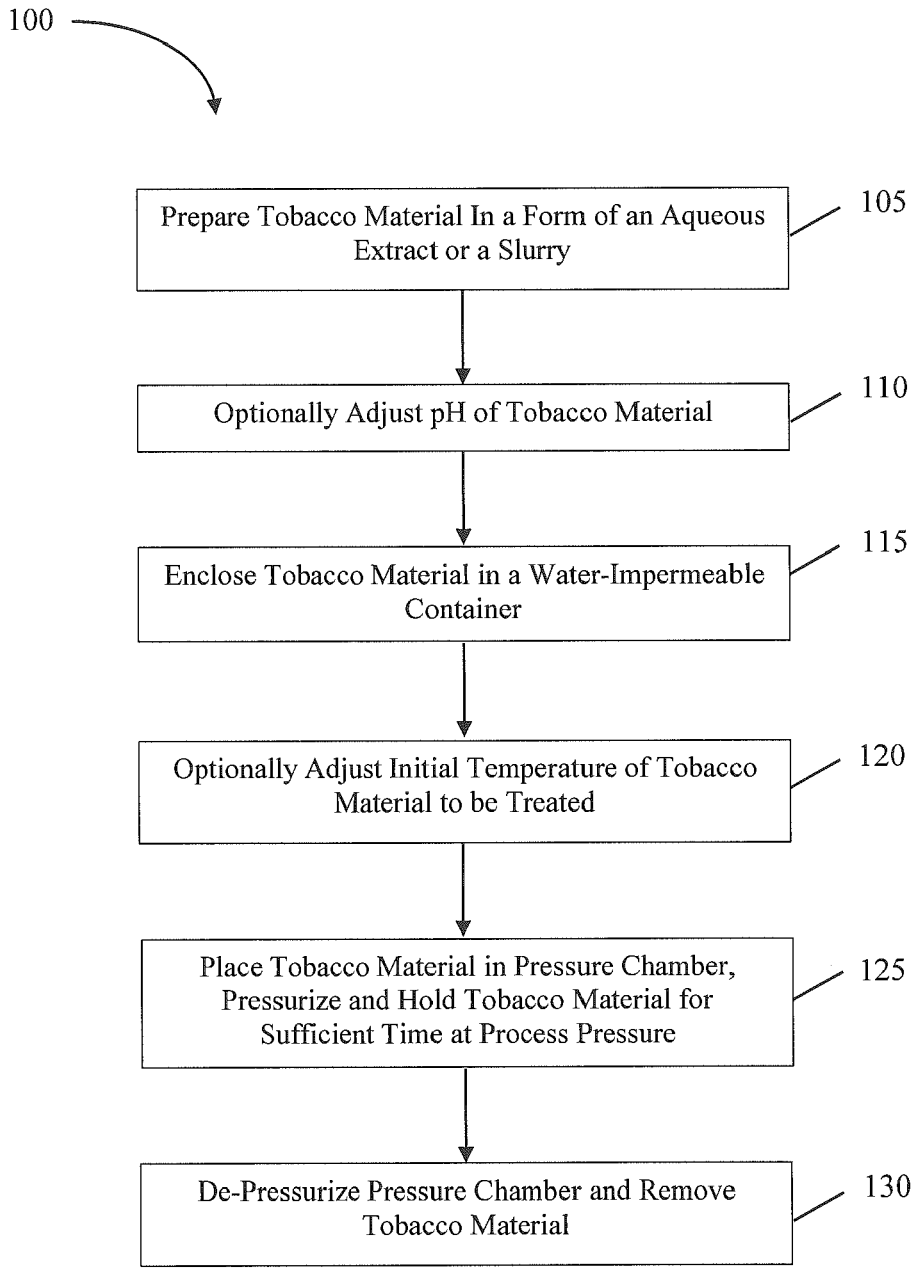
FIG. 1 is a flow chart describing methods of treating a tobacco material to enhance storage stability.

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The present invention provides methods of treating a tobacco material to enhance storage stability and tobacco products derived therefrom. The methods can comprise receiving a tobacco material having at least about 50% water based on the total weight, and subjecting the tobacco material to high pressure processing to form a high pressure processed tobacco material. The high pressure processed tobacco material can have a storage stability of at least about 25 days, wherein the storage stability is defined as an aerobic plate count below about 3,000,000 CFU/g.

The materials of the disclosure undergoing enhanced storage treatment will typically incorporate some form of a plant of the *Nicotiana* species, and most preferably, those materials to be treated incorporate some form of tobacco. The selection of the plant from the *Nicotiana* species can vary; and in particular, the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and *Galpao* tobaccos), Indian air cured, Red Russian and *Rustica* tobaccos, as well as various other rare or specialty tobaccos. Descriptions of various types of tobaccos, growing practices and harvesting practices are set forth in *Tobacco Production, Chemistry and Technology*, Davis et al. (Eds.) (1999), which is incorporated herein by reference. *Nicotiana* species can be derived using genetic-modification or crossbreeding techniques (e.g., tobacco plants can be genetically engineered or crossbred to increase or decrease production of or to other change certain components, characteristics or attributes). Additional information on types of *Nicotiana* species suitable for use in the present invention can be found in US Pat. Appl. Pub. No. 2012/0192880 to Dube et al., which is incorporated by reference herein. Tobacco plants can be grown in greenhouses, growth chambers, or outdoors in fields, or grown hydroponically.

The portion or portions of the plant of the *Nicotiana* species used according to the present invention can vary. For example, virtually all of the plant (e.g., the whole plant) can be harvested, and employed as such. Alternatively, various parts or pieces of the plant can be harvested or separated for further use after harvest. For example, the leaves, stem, stalk, roots, lamina, flowers, seed, and various portions and combinations thereof, can be isolated for further use or treatment. The plant material of the invention may thus comprise an entire plant or any portion of a plant of the *Nicotiana* species. See, for example, the portions of tobacco plants set forth in US Pat. Appl. Pub. Nos. 2011/0174323 to Coleman, III et al. and 2012/0192880 to Dube et al., which are incorporated by reference herein.

The plant of the *Nicotiana* species can be employed in either an immature or mature form, and can be used in either a green form or a cured form, as described in 2012/0192880 to Dube et al., which is incorporated by reference herein.

The tobacco material can be subjected to various treatment processes such as, refrigeration, freezing, drying (e.g., freeze-drying or spray-drying), irradiation, yellowing, heating, cooking (e.g., roasting, frying or boiling), fermentation, bleaching, or otherwise subjected to storage or treatment for later use. Exemplary processing techniques are described, for example, in US Pat. Appl. Pub. Nos. 2009/0025739 to Brinkley et al. and 2011/0174323 to Coleman, III et al., which are incorporated by reference herein.

Tobacco materials can be treated with enzymes and/or probiotics before or after harvest, as discussed in US Pat. Appl. Pub. Nos. 2013/0269719 Marshall et al. and 2014/0020694 to Moldoveanu, which are incorporated herein by reference. Tobacco materials may be irradiated, pasteurized, or otherwise subjected to controlled heat treatment. Representative processes are set forth in US Pat. Pub. Nos. 2009/0025738 to Mua et al.; 2009/0025739 to Brinkley et al.; and 2011/0247640 to Beeson et al., which are incorporated herein by reference. In one embodiment, the tobacco material is heat treated in the presence of water, NaOH, and an additive (e.g., lysine) at about 88° C. for about 60 minutes. Such heat treatment can help prevent acrylamide production resulting from reaction of asparagine with reducing sugars in tobacco materials and can provide some degree of pasteurization. See, for example, US Pat. Pub. No. 2010/0300463 to Chen et al., which is incorporated herein by reference. The tobacco material can be brought into contact with an imprinted polymer or non-imprinted polymer such as described, for example, in US Pat. Pub. Nos. 2007/0186940 to Bhattacharyya et al; 2011/0041859 to Rees et al.; 2011/0159160 to Jonsson et al; and 2012/0291793 to Byrd et al., all of which are incorporated herein by reference.

A harvested portion or portions of the plant of the *Nicotiana* species can be physically processed. A portion or portions of the plant can be separated into individual parts or pieces (e.g., roots can be removed from stalks, stems can be removed from stalks, leaves can be removed from stalks and/or stems, petals can be removed from the remaining portion of the flower). The harvested portion or portions of the plant can be further subdivided into parts or pieces (e.g., shredded, cut, comminuted, pulverized, milled or ground into pieces or parts that can be characterized as filler-type pieces, granules, particulates or fine powders). The harvested portion or portions of the plant can be subjected to external forces or pressure (e.g., by being pressed or subjected to roll treatment). When carrying out such processing conditions, the harvested portion or portions of the plant can have a moisture content that approximates its natural moisture content (e.g., its moisture content immediately upon harvest), a moisture content achieved by adding moisture to the harvested portion or portions of the plant, or a moisture content that results from the drying of the harvested portion or portions of the plant.

In certain embodiments, the tobacco material is used in a form that can be described as particulate (i.e., shredded, ground, granulated, or powder form). The manner by which the tobacco material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. For example, tobacco parts or pieces may be ground or milled when the moisture content thereof is less than about 15 weight percent or less than about 5 weight percent. Most preferably, the tobacco material is employed in the form of parts or pieces that have an average particle size less than about 50 microns. In one embodiment, the average particle size of the tobacco particles may be less than or equal to about 25 microns. In some instances, the tobacco particles may be sized to pass through a screen mesh. If desired, air classification equipment may be used to ensure that small sized tobacco particles of the desired sizes, or range of sizes, may be collected. If desired, differently sized pieces of granulated tobacco may be mixed together. Use of micro-milled tobacco particles (or other micro-sized botanical components) can be advantageous where the user prefers to reduce or eliminate product waste after use.

In certain embodiments, at least a portion of the tobacco material can have the form of an extract. Tobacco extracts can be obtained by extracting tobacco using a solvent having an aqueous character such as distilled water or tap water. As such, aqueous tobacco extracts can be provided by extracting tobacco with water, such that water insoluble pulp material is separated from the aqueous solvent and the water soluble and dispersible tobacco components dissolved and dispersed therein. Exemplary techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,284,875 to Turpen et al.; U.S. Pat. No. 6,298,859 to Kierulff et al.; U.S. Pat. No. 6,772,767 to Mua et al.; U.S. Pat. No. 6,817,970 to Befit et al.; U.S. Pat. No. 6,906,172 to Bratcher et al.; U.S. Pat. No. 7,034,128 to Turpen et al.; U.S. Pat. No. 7,048,211 to Bratcher et al.; and U.S. Pat. No. 7,337,782 to Thompson, all of which are incorporated by reference herein. See also, the ultrafiltered translucent tobacco extracts set forth in US Pat. Appl. Pub. Nos. 2013/0074855 and 2013/0074856, both to Holton, Jr., which are incorporated by reference herein.

The tobacco-derived extract will typically comprise a mixture of desired components isolated from a plant of the *Nicotiana* species by various means. However, if desired, the tobacco-derived extract can be highly purified with respect to a single component of the extract or a small number of extract components. Typical separation processes that can further purify or isolate components of a tobacco extract include one or more process steps such as solvent extraction (e.g., using polar solvents, organic solvents, or supercritical fluids), chromatography (e.g., preparative liquid chromatography), clarification, distillation, filtration (e.g., ultrafiltration), recrystallization, and/or solvent-solvent partitioning. In some embodiments, a plant or a portion thereof is pre-treated, e.g., to liberate certain compounds to make the desired compounds available for more efficient separation. In some embodiments, multiple methods are used to isolate and/or purify the desired compounds. See, for example, the description of isolated tobacco components and techniques for isolation in US Pat. Appl. Pub. Nos. 2011/0174323 to Coleman, III et al.; 2011/0259353 to Coleman, III et al.; 2012/0192880 to Dube et al.; 2012/0192882 to Dube et al.; and 2012/0211016 to Byrd, Jr. et al., which are incorporated by reference herein.

Tobacco extracts of the present disclosure can, in some embodiments, be characterized as translucent or transparent. In certain embodiments, such extracts can be characterized by the molecular weight of their components. For example, a translucent tobacco extract can consist of compounds having a molecular weight of less than about 50,000 Da., or compounds having a molecular weight of less than about 5,000 Da. The translucency of a tobacco extract can be characterized by a percent light transmittance (compared to water at 100% transmittance), such as a percent light transmittance of at least about 30% at visible light wavelengths greater than about 600 nm, or a percent light transmittance of at least about 40% at visible light wavelengths greater than about 600 nm, or a percent light transmittance of at least about 50% at visible light wavelengths greater than about 600 nm (or even higher levels such as greater than about 60% or greater than about 70% or greater than about 80% at visible light wavelengths greater than about 600 nm).

Reference to "tobacco extract" as explained above encompasses extracts highly purified with respect to one or a few components thereof. For example, highly purified tobacco-derived nicotine (e.g., pharmaceutical grade nicotine having a purity of greater than 98% or greater than 99%) or a derivative thereof can be used in the present invention. Representative nicotine-containing extracts can be provided using the techniques set forth in U.S. Pat. No. 5,159,942 to Brinkley et al., which is incorporated herein by reference. Extracts containing relatively high nicotine content can be buffered, e.g., using buffering agents such as citric acid to lower the pH of the extracts.

The form of the tobacco extract (or isolate therefrom) obtained according to the present invention can vary. Typically, the isolate is in a solid, liquid, or semi-solid form. The formulation can be used in concrete, absolute, or neat form. Solid forms of the tobacco isolate can include spray-dried and freeze-dried forms (e.g., freeze-dried flue cured extract or spray-dried fire-cured extract). Liquid forms of the tobacco isolate can include formulations contained within aqueous or organic solvent carriers.

In certain embodiments, the tobacco materials undergoing enhanced storage treatment can include nicotine in any form from any source, whether tobacco-derived or synthetically-derived. Normally, nicotinic compounds used in the present invention are selected from the group consisting of nicotine base, nicotine hydrochloride, nicotine dihydrochloride, nicotine monotartrate, nicotine bitartrate, nicotine sulfate, nicotine zinc chloride such as nicotine zinc chloride monohydrate and nicotine salicylate. In some embodiments, nicotine is in its free base form, which can optionally be sorbed on a carrier (e.g., microcrystalline cellulose) for inclusion in a tobacco material. See, for example, the nicotine/carrier compositions set forth in US Pat. Pub. No. 2004/0191322 to Hansson, which is incorporated by reference herein.

In addition to (or in lieu of in certain embodiments) the above-noted tobacco material, materials of the invention can include a further non-tobacco botanical material. As used herein, the term "botanical material" refers to any plant material, including plant material in its natural form and plant material derived from natural plant materials, such as extracts or isolates from plant materials or treated plant materials (e.g., plant materials subjected to heat treatment, fermentation, or other treatment processes capable of altering the chemical nature of the material). See, e.g., exemplary botanical materials disclosed in U.S. Pat. Pub. No. 2015/0068544 to Moldoveanu et al., herein incorporated by reference. When present in the composition undergoing treatment, such botanical materials can be used in the same forms noted above with respect to tobacco (e.g., milled particulates or extracts) and the amounts utilized can depend on the desired use of the tobacco material treated to enhance storage life.

Depending on the type of tobacco material being processed, the tobacco material can include one or more additional components in addition to the tobacco material. For example, the tobacco material can be processed, blended, formulated, combined and/or mixed with other materials or ingredients, such as other tobacco materials or flavorants, fillers, binders, pH adjusters, buffering agents, salts, sweeteners, colorants, disintegration aids, humectants, and preservatives (any of which may be an encapsulated ingredient). See, for example, those representative components, combination of components, relative amounts of those components and ingredients relative to tobacco, and manners and methods for employing those components, set forth in US Pat. Pub. Nos. 2011/0315154 to Mua et al. and 2007/

0062549 to Holton, Jr. et al. and U.S. Pat. No. 7,861,728 to Holton, Jr. et al., each of which is incorporated herein by reference.

High pressure processing (HPP), also known as high hydrostatic pressure processing or ultra-high pressure processing, is a cold pasteurization technique by which materials that are sealed in a package, can be introduced into a vessel and subjected to a high level of isostatic pressure transmitted by a pressurizing medium such as a liquid or a gas (e.g., water). See, e.g., discussion of High Pressure Processing (HPP) available at http://www.hiperbaric.com/en/high-pressure; and *Kinetics of Microbial Inactivation for Alternative Food Processing Technologies—High Pressure Processing* available at http://www.fda.gov/Food/FoodScienceResearch/SafePracticesforFoodProcesses/ucm101456.htm; each of which is herein incorporated by reference. Tobacco materials, as described above, can be subjected to high pressure processing (HPP) to form a high pressure processed tobacco material. Tobacco materials that have undergone HPP treatment can have an enhanced shelf life. For example, HPP can provide materials having at least double and triple shelf lives without the use of chemicals, additives or heat. During HPP, the high pressure destroys pathogenic microorganisms by interrupting their cellular functions. Within a living bacteria cell, many pressure sensitive processes such as protein function, enzyme action, and cellular membrane function are impacted by high pressure, resulting in the inability of the bacteria to survive. Small macromolecules that can contribute to flavor, odor, and nutrition are typically not changed by pressure. HPP offers several advantages over traditional thermal processing including reduced process times, minimal heat damage, and retention of freshness, flavor, texture, color, and nutrients. As such, HPP can offer a commercially viable and practical alternative to heat processing by allowing processors to pasteurize materials at or near room temperature. See, e.g., Balasubramaniam et al., *High-pressure Food Processing*, Food Sci. Tech. Eng. 14(5) (2008), pp. 413-418, and Baldo et al., J. Food Sci. Eng. 2 (2012), 543-549, herein incorporated by reference.

HPP is based on the Le Chatelier principle which states that a system at equilibrium adjusts when subjected to a stress and that chemical reactions resulting in a decrease in total volume are enhanced by pressure and chemical reactions resulting in an increase in total volume are slowed down by pressure. An HPP process is not dependent on the volume of the material being treated. HPP utilizes isostatic or hydrostatic pressure which is equal from every direction. Isostatic compression transfers pressure instantly and uniformly throughout the pressure medium providing a non-thermal process alternative for the pasteurization of temperature-sensitive materials. Materials suspended in the pressure medium are assumed to follow the isostatic principle. The basis for using the HPP process as a pasteurization method is based on the assumption that the product also follows the isostatic rule, which states that isostatic pressure is instantly and uniformly transmitted throughout the pressurized medium and the enclosed tobacco material, regardless of size, shape or physical state of the tobacco material.

As illustrated in FIG. 1, for example, high pressure processing methods described herein can comprise placing a packaged tobacco material having a high moisture content in a pressure chamber that can be filled with a pressurizing fluid or gas that can be pressurized though any means known in the art. The pressurizing fluid can then apply pressure to the material for a sufficient duration and degree to process the material. The entire process can take 10 minutes or less. See, e.g., the processing methods and equipment disclosed in U.S. Pat. No. 6,322,837 to Nakayama; and U.S. Pat. Pub. Nos. 2004/0045450 to Hernando; and 2008/0311259 to Singh et al., herein incorporated by reference. It is noted that the order of operations in HPP treatment method 100 is not intended to be limiting.

As illustrated at operation 105 of HPP treatment method 100, for example, tobacco materials can be prepared for processing. As described above, tobacco materials can be in a particulate form and/or in the form of an extract. For HPP treatment methods, samples having lower water activity can be less susceptible to HPP treatment (i.e., low water activities can at least partially prevent inactivation of the pathogenic microorganisms). As such, in preferred embodiments of the present invention, tobacco materials can be in the form of an aqueous extract and/or a slurry. In various embodiments of the present invention, the tobacco material undergoing HPP treatment can have a moisture content of at least about 40%, at least about 50%, at least about 75%, or at least about 80% based on total weight of the sample. The preferred moisture content can vary depending on the type and/or form of tobacco material undergoing treatment. In some embodiments, the tobacco material can be in the form of a wet tobacco particulate material. In certain embodiments, the tobacco material can be in the form of an aqueous tobacco extract.

As illustrated at operation 110, for example, in various embodiments of the present invention the pH of the tobacco material can be adjusted. Inactivation of pathogenic microorganisms can be enhanced by exposure to acidic pH. Compression of samples can shift the pH of the sample. The direction of the pH shift and the magnitude can be determined for each material undergoing an HPP treatment process. As pH is lowered, most microbes become more susceptible to HPP inactivation. In various embodiments of the present invention, the pH of the tobacco material undergoing HPP treatment can be adjusted to be in the range of about 4 to about 6, or about 5 to about 6. The pH of a sample can be measured at the initial temperature of the sample prior to treatment and at atmospheric pressure via any means known in the art.

As illustrated at operation 115, for example, before placing the tobacco material into the pressure chamber, the tobacco material can be packaged in a water resistant container capable of undergoing the HPP treatment process. See, e.g., the packages and methods of packing described in U.S. Pat. No. 8,507,020 to DesLauriers et al. and U.S. Pat. Pub. No. 2006/0099306 to Miller, each of which is herein incorporated by reference. The container can be such that the pressurizing medium (e.g., the liquid or the gas in the pressure chamber) is unable to penetrate the container during the HPP treatment process and thereby contaminate the sample undergoing treatment. For example, in certain embodiments, tobacco material can be hermetically sealed into Mylar® heat sealable bags.

Before pressurizing the tobacco material, the pressure chamber can be set to reach a target pressure which can vary depending on the material to be treated. The pressure at which a sample to be treated is held in a pressure vessel can be referred to as process pressure. In various embodiments of the present invention, the pressure within the pressure chamber during HPP treatment of a tobacco material can be about 30,000 psi to about 130,000 psi, about 50,000 psi to about 100,000 psi, or about 70,000 psi to about 90,000 psi during processing of the material. In a preferred embodiment, the process pressure can be about 86,000 psi. In various embodiments of the present invention, the process pressure can be at least about 30,000 psi, at least about 50,000 psi, at least about 75,000 psi, at least about 100,000 psi, or at least about 125,000 psi.

The temperature at which a product undergoing processing attains after the target process pressure is reached can be referred to as process temperature. Process temperature can be governed by the initial temperature of the sample to be treated. As illustrated at operation 120, for example, the initial temperature of the tobacco material can be adjusted prior to pressurizing the sample. For example, conventionally, food pasteurization applications products can be chilled before undergoing HPP whereas for sterilization of low-acid foods, products can be preheated to about 50 to about 70° C. See, e.g., Basic Concepts of High Pressure Processing available at http://grad.fst.ohio-state.edu/hpp/concepts.html; herein incorporated by reference. For example, the tobacco material can be at ambient temperature (e.g., about 37° C.) or it can be chilled (e.g., to about 4° C.) before undergoing an HPP treatment process. Other initial temperatures of the tobacco material can be used without departing from the present invention.

As illustrated at operation 125, for example, after preparing packaged tobacco material, the material can be placed into a pressure chamber and pressurized at a desired process pressure for a sufficient time to inactivate undesirable microorganisms. The duration of time that a sample is subjected to the process pressure and process temperature can be referred to as a holding time or a process time. The holding time can be balanced to be long enough so that the maximum level of undesirable microorganisms are inactivated, but also not too long so that negative side effects occur (e.g., other undesirable microorganisms grow). In certain embodiments, samples with lower moisture content can require longer process times. In various embodiments of the present invention, the process time can be at least about 30 seconds, at least about 60 seconds, at least about 120 seconds, at least about 180 seconds, at least about 240 seconds, at least about 300 seconds, or at least about 360 seconds. In various embodiments, the holding time for tobacco material undergoing treatment can be in a range of about 30 seconds to about 380 seconds, about 60 seconds to about 300 seconds, or about 180 seconds to about 300 seconds.

As illustrated at operation 130, for example, following pressurization of the tobacco material for the desired holding time, the pressure chamber can be de-pressurized and the treated tobacco material can be removed. One advantage of HPP treatment methods is that pressure transmission is relatively instantaneous and uniform, and HPP is not controlled by product size and is effective throughout the tobacco materials. Depending on the come-up time (i.e., period necessary to reach process pressure) and the pressure-release time, the entire HPP treatment process can be completed in less than 10 minutes, for example. It is noted that come-up time and pressure-release time can also affect inactivation kinetics of microorganisms. As such, it may be necessary to adjust the holding time based on the come-up time and/or the pressure-release time.

After undergoing an HPP treatment, a tobacco material can have an increased storage stability due to the inactivation of microorganisms. In the context of tobacco and food products, once a product reaches a certain level of microorganisms, it is no longer viable for use (i.e., consumption). The aerobic plate count (APC) of a product is a parameter used to indicate the level of microorganisms in a product. The APC of a product can be measured in colony forming units per gram of sample tested (CFU/g). Detailed procedures for determining the APC of a material have been developed by the Association of Official Analytical Chemists (AOAC) and the American Public Health Association (APHA). See, e.g., American Public Health Association. 1984. Compendium of Methods for the Microbiological Examination of Foods, $2^{nd}$ ed. APHA, Washington, D.C.; Association of Official Analytical Chemists. 1990. Official Methods of Analysis, $15^{th}$ ed. AOAC, Arlington, Va.; and *BAM: Aerobic Plate Count* available at http://www.fda.gov/Food/FoodScienceResearch/LaboratoryMethods/ucm063346.htm; each of which is herein incorporated by reference.

As used herein, "storage stability" of a product is defined as a length of time where the APC value of a product remains below a maximum APC value, beyond which the microbial count renders the product unusable for its desired purpose. Due to the fact that APC values increase over time as a result of the growth of microorganisms in a product, as used herein, an "increased storage stability" refers to an increase in the amount of time that the APC value of the product remains below the APC threshold (i.e., maximum APC value before product is rendered unusable). In various embodiments, an HPP treatment process can increase the storage stability of a treated tobacco material as compared to the storage stability of a non-treated tobacco material by at least about 20 days, by at least about 25 days, by at least about 50 days, by at least about 75 days, or by at least about 100 days. In some embodiments, an HPP treatment process can increase the storage stability of a treated tobacco material as compared to a non-treated tobacco material by at least about 200%, by at least about 300%, by at least about 400%, or by at least about 500%.

Refrigeration can further increase the storage stability of a product. Refrigeration can increase the storage stability of an HPP treated tobacco material stored at a temperature of about 10° C. or less as compared to an HPP treated tobacco material stored at room temperature by at least about 20 days, by at least about 25 days, by at least about 50 days, by at least about 75 days, or by at least about 100 days. Refrigeration can increase the storage stability of an HPP treated tobacco material stored at a temperature of about 10° C. or less as compared to an HPP treated tobacco material stored at room temperature by at least about 200%, by at least about 300%, by at least about 400%, or by at least about 500%.

In various embodiments of the present invention, the maximum APC value of a tobacco material in the Rain of an aqueous extract can be about 3,000,000 CFU/g. The storage stability of an untreated aqueous tobacco extract stored at ambient temperature can be less than about one day. HPP treatment can significantly increase the storage stability of tobacco material. The storage stability of an aqueous tobacco extract subjected to an HPP treatment process and stored at ambient temperature can be at least about 25 days. An HPP treatment process can also increase the storage stability of a refrigerated tobacco material. The storage stability of an untreated aqueous tobacco extract stored at about 4° C. can be between about 25 days to about 50 days. The storage stability of an aqueous tobacco extract subjected to an HPP treatment process and stored at about 4° C. can be between about 100 days to about 150 days.

Tobacco materials that have undergone an HPP treatment process as described above can be useful in various tobacco products. The tobacco product to which the materials of the invention are added can vary, and can include any product configured or adapted to deliver tobacco or some component thereof to the user of the product. Exemplary tobacco products include smoking articles (e.g., cigarettes), smokeless tobacco products, and aerosol-generating devices that contain a tobacco material or other plant material that is not combusted during use.

Figure 2:
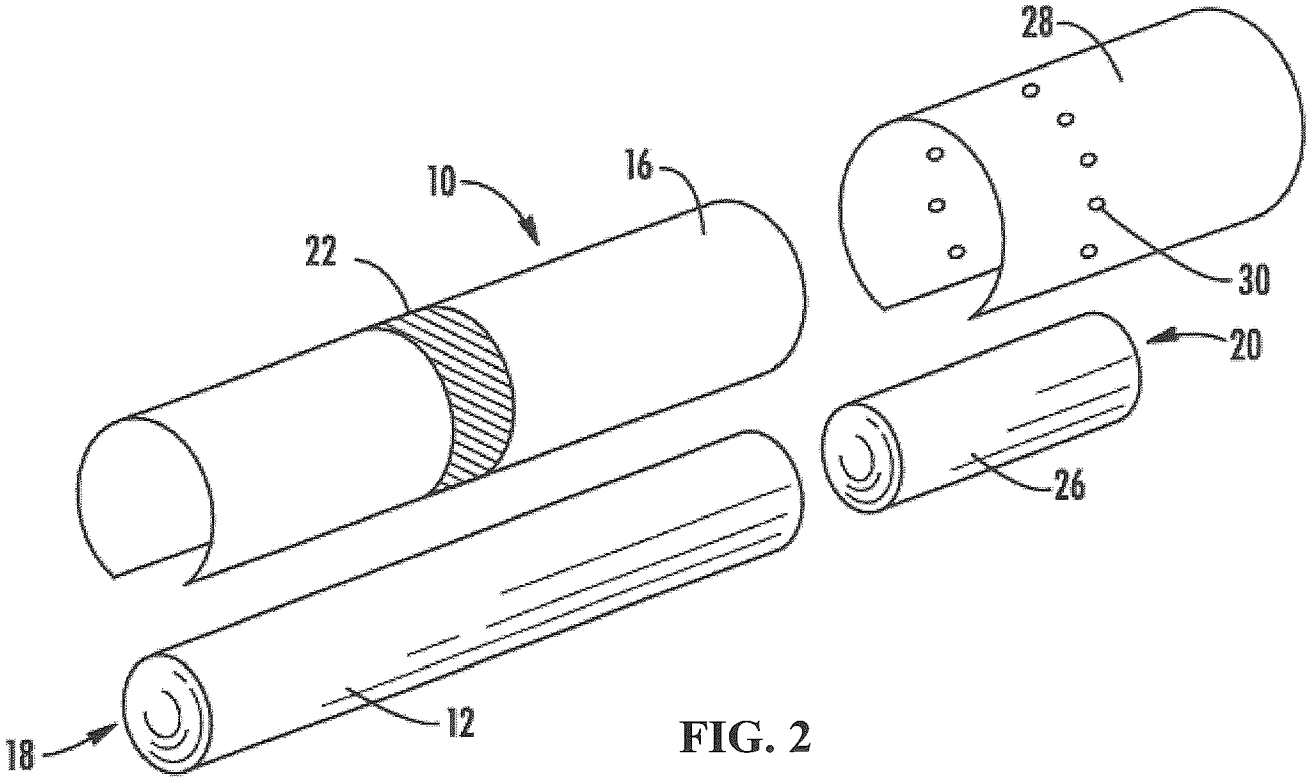
FIG. 2 is an exploded perspective view of a smoking article having the form of a cigarette, showing the smokable material, the wrapping material components, and the filter element of the cigarette.

Referring to FIG. 2, there is shown a smoking article 10 in the form of a cigarette and possessing certain representative components of a smoking article that can contain HPP treated tobacco materials of the present invention. The cigarette 10 includes a generally cylindrical rod 12 of a charge or roll of smokable filler material (e.g., about 0.3 to about 1.0 g of smokable filler material such as tobacco material) contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. The band 22 can be printed on the inner surface of the wrapping material (i.e., facing the smokable filler material), or less preferably, on the outer surface of the wrapping material.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough. A plug wrap 28 enwraps the filter element and a tipping material (not shown) enwraps the plug wrap and a portion of the outer wrapping material 16 of the rod 12, thereby securing the rod to the filter element 26.

Figure 3:
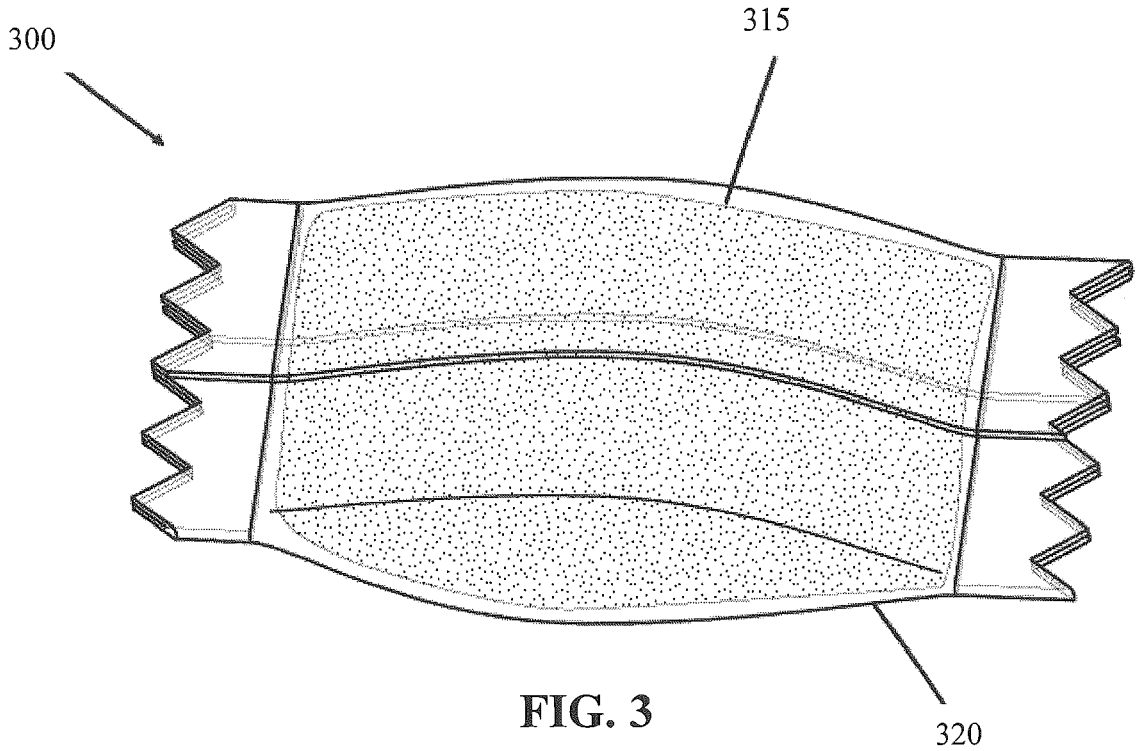
FIG. 3 is a top view of a smokeless tobacco product embodiment, taken across the width of the product, showing an outer pouch filled with a tobacco material.

In various embodiments, smokeless tobacco products can comprise HPP treated tobacco materials. The form of the smokeless tobacco product of the invention can vary. In one particular embodiment, the product is in the form of a snus-type product containing a particulate HPP treated tobacco material and other ingredients known in the art. Manners and methods for formulating snus-type tobacco formulations will be apparent to those skilled in the art of snus tobacco product production. For example, as illustrated in FIG. 3, an exemplary pouched product 300 can comprise an outer water-permeable container 320 in the form of a pouch which contains a particulate mixture 315 adapted for oral use. The orientation, size, and type of outer water-permeable pouch and the type and nature of the composition adapted for oral use that are illustrated herein are not construed as limiting thereof.

In various embodiments, a moisture-permeable packet or pouch can act as a container for use of the composition within. The composition/construction of such packets or pouches, such as the container pouch 320 in the embodiment illustrated in FIG. 3, may be varied as noted herein. For example, suitable packets, pouches or containers of the type used for the manufacture of smokeless tobacco products, which can be modified according to the present invention, are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. A pouch type of product similar in shape and form to various embodiments of a pouched product described herein is commercially available as ZONNIC (distributed by Niconovum AB). Additionally, pouch type products generally similar in shape and form to various embodiments of a pouched product are set forth as snuff bag compositions E-J in Example 1 of PCT WO 2007/104573 to Axelsson et al., which is incorporated herein by reference, which are produced using excipient ingredients and processing conditions that can be used to manufacture pouched products as described herein.

The relative amount of HPP treated tobacco material within the smokeless tobacco composition may vary, and depends in part on the type of tobacco material employed (e.g., milled tobacco or tobacco extract). Preferably, the total amount of HPP treated tobacco material (from any source including tobacco extracts or isolates and particulate tobacco material) formulation within the smokeless tobacco product is between about 0.01 and about 40 weight percent based on total weight of the composition, more typically between about 0.2 and about 20 weight percent (e.g., between about 0.3 and about 10 weight percent). For embodiments containing only HPP treated tobacco extract as the tobacco component (including pharmaceutical grade nicotine), the smokeless tobacco product will typically contain no more than about 10 weight percent of tobacco component, such as no more than about 8 weight percent, no more than about 5 weight percent, or no more than about 3 weight percent (e.g., about 0.01 to about 10 weight percent). For embodiments containing an HPP treated particulate tobacco component (e.g., a finely milled tobacco), either as the sole tobacco component or in combination with a tobacco extract, the smokeless tobacco product will typically contain no more than about 20 weight percent of tobacco component, such as no more than about 15 weight percent, no more than about 10 weight percent, or no more than about 8 weight percent (e.g., about 1 to about 12 weight percent). The amount of HPP treated tobacco material (or combination of tobacco material with other botanical components) will typically not exceed 50 weight percent.

The invention is not limited to snus-type smokeless tobacco products. For example, HPP treated tobacco materials can also be incorporated into various smokeless tobacco forms such as loose moist snuff, loose dry snuff, chewing tobacco, pelletized tobacco pieces, extruded tobacco strips or pieces, finely divided or milled agglomerates of powdered pieces and components, flake-like pieces (e.g., that can be foliated by agglomerating tobacco formulation components in a fluidized bed), molded tobacco pieces (e.g., formed in the general shape of a coin, cylinder, bean, cube, or the like), pieces of tobacco-containing gum, products incorporating mixtures of edible material combined with tobacco pieces and/or tobacco extract, products incorporating tobacco (e.g., in the form of tobacco extract) carried by a solid inedible substrate, and the like. For example, the smokeless tobacco product can have the form of compressed tobacco pellets, multi-layered extruded pieces, extruded or formed rods or sticks, compositions having one type of tobacco formulation surrounded by a different type of tobacco formulation, rolls of tape-like films, readily water-dissolvable or water-dispersible films or strips (see, for example, US Pat. Appl. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtoniam fluid or a thixotropic fluid incorporating tobacco of some finial).

In some embodiments, smokeless tobacco products of the invention can have the form of a lozenge, tablet, microtab, or other tablet-type product. See, for example, the types of lozenge formulations and techniques for formulating or manufacturing lozenges set forth in U.S. Pat. No. 4,967,773 to Shaw; U.S. Pat. No. 5,110,605 to Acharya; U.S. Pat. No. 5,733,574 to Dam; U.S. Pat. No. 6,280,761 to Santus; U.S. Pat. No. 6,676,959 to Andersson et al.; U.S. Pat. No. 6,248,760 to Wilhelmsen; and U.S. Pat. No. 7,374,779; US Pat. Pub. Nos. 2001/0016593 to Wilhelmsen; 2004/0101543 to Liu et al.; 2006/0120974 to Mcneight; 2008/0020050 to Chau et al.; 2009/0081291 to Gin et al.; and 2010/0004294 to Axelsson et al.; which are incorporated herein by reference.

In various embodiments, HPP treated tobacco materials can be incorporated into an electronic smoking article. There have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. Pub. Nos. 2013/0255702 to Griffith Jr. et al., 2014/0000638 to Sebastian et al., 2014/0060554 to Collett et al., 2014/0096781 to Sears et al., 2014/0096782 to Ampolini et al., and U.S. patent application Ser. No. 14/011,992 to Davis et al., filed Aug. 28, 2013, which are incorporated herein by reference in their entirety.

Figure 4:
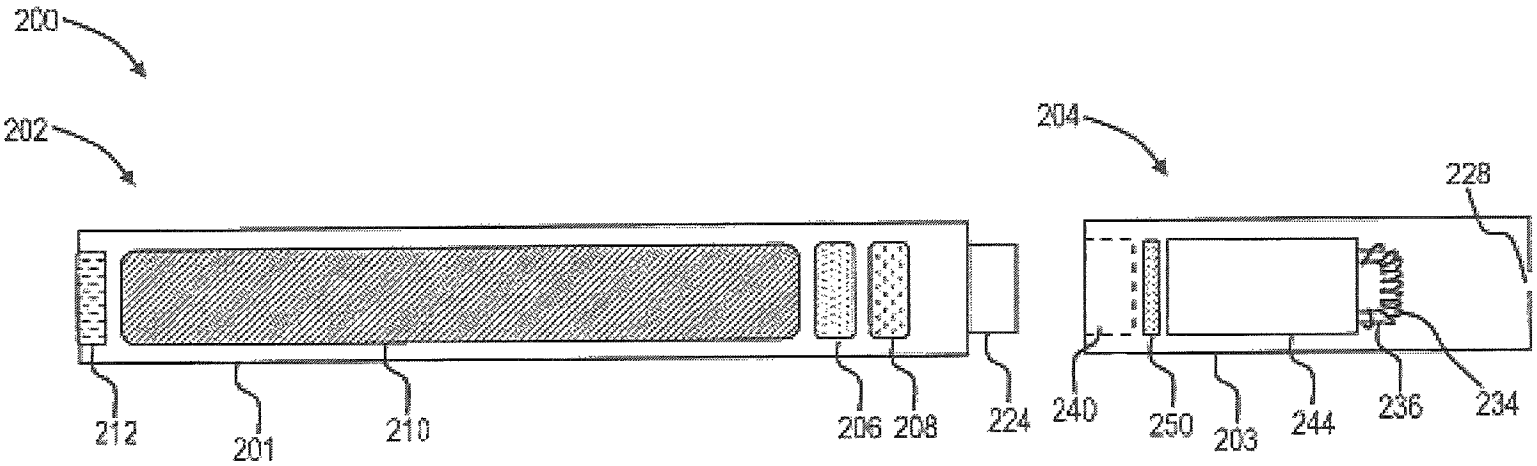
FIG. 4 is a sectional view through an electronic smoking article comprising a cartridge and a control body and including a reservoir housing according to an example embodiment of the present disclosure.

An exemplary embodiment of an electronic smoking article 200 is shown in FIG. 4. As illustrated therein, a control body 202 can be formed of a control body shell 201 that can include a control component 206, a flow sensor 208, a battery 210, and an LED 212. A cartridge 204 can be formed of a cartridge shell 203 enclosing a reservoir housing 244 that is in fluid communication with a liquid transport element 236 adapted to wick or otherwise transport an aerosol precursor composition stored in the reservoir housing to a heater 234. An opening 228 may be present in the cartridge shell 203 to allow for egress of formed aerosol from the cartridge 204. Such components are representative of the components that may be present in a cartridge and are not intended to limit the scope of cartridge components that are encompassed by the present disclosure. The cartridge 204 may be adapted to engage the control body 202 through a press-fit engagement between the control body projection 224 and the cartridge receptacle 240. Such engagement can facilitate a stable connection between the control body 202 and the cartridge 204 as well as establish an electrical connection between the battery 210 and control component 206 in the control body and the heater 234 in the cartridge. The cartridge 204 also may include one or more electronic components 250, which may include an IC, a memory component, a sensor, or the like. The electronic component 250 may be adapted to communicate with the control component 206. The various components of an electronic smoking device according to the present disclosure can be chosen from components described in the art and commercially available.

In various embodiments, the aerosol precursor composition can comprise an HPP treated tobacco material. Exemplary formulations for aerosol precursor materials that may be used according to the present disclosure are described in U.S. Pat. No. 7,217,320 to Robinson et al.; U.S. Pat. Pub. Nos. 2013/0008457 to Zheng et al.; 2013/0213417 to Chong et al.; 2014/0060554 to Collett et al.; and 2014/0000638 to Sebastian et al., the disclosures of which are incorporated herein by reference in their entirety. Other aerosol precursors that can incorporate the HPP treated tobacco materials described herein include the aerosol precursors that have been incorporated in the VUSE® product by R. J. Reynolds Vapor Company, the BLU™ product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC.

EXPERIMENTAL

Aspects of the present invention are more fully illustrated by the following examples, which are set forth to illustrate certain aspects of the present invention and are not to be construed as limiting thereof.

Example 1

Tobacco material in the form of an aqueous extract undergoes an HPP treatment process and illustrates an increased storage life as compared to an untreated tobacco material in the form of an aqueous extract.

Six samples of an aqueous tobacco extract are prepared. The extract used is known to contain microbes that would proliferate if not irradiated. Two samples are control samples and not subjected to an HPP treatment process. One of the control samples is stored at ambient temperature. A second control sample is stored at 4° C. Four of the samples undergo an HPP treatment process, as described in more detail below.

For the HPP treatment, a Quintus® 35L-600 pressure vessel manufactured by Avure® Technologies is used. For each sample, 250 mL of the extract is hermetically sealed into Mylar® heat sealable bags. The samples are loaded into a cylindrical load basket, which is loaded manually or automatically with the help of a hoist into the vessel. The vessel is closed and pressurized. The water-filled vessel is pressurized with the 7XS-6000 intensifier pump. The pressure is held for the desired hold time at the preset temperature. The vessel is decompressed, opened, and the load basket is removed. The process parameters are recorded for each cycle.

Two samples undergo an HPP treatment process wherein the pressure in the process pressure chamber is set to 86,000 psi and the process time (i.e., the time the samples are held at the process pressure) is 180 seconds. One of these 180 second HPP treated samples is stored at ambient temperature and the other is stored at 4° C. Two samples undergo an HPP treatment process wherein the pressure in the process pressure chamber is set to 86,000 psi and the process time (i.e., the time the samples are held at the process pressure) is 300 seconds. One of these 300 second HPP treated samples is stored at ambient temperature and the other is stored at 4° C.

Aerobic plate count (APC) readings are taken approximately every 25 days. The data points are listed in the tables below.

TABLE 1

Aerobic plate count readings measured in CFU/g for aqueous tobacco extract samples stored at ambient temperature

| Days After HPP | Product | APC (CFU/g) |
|---|---|---|
| 1 | Control (no HPP) | 4,000,000 |
| | HPP with 180 sec hold time | 2,400 |
| | HPP with 300 sec hold time | 1,000 |
| 25 | Control (no HPP) | 23,000,000 |
| | HPP with 180 sec hold time | 2,200,000 |
| | HPP with 300 sec hold time | 1,900,000 |

TABLE 1-continued

| Aerobic plate count readings measured in CFU/g for aqueous tobacco extract samples stored at ambient temperature | | |
|---|---|---|
| Days After HPP | Product | APC (CFU/g) |
| 50 | Control (no HPP) | TNTC* |
| | HPP with 180 sec hold time | TNTC* |
| | HPP with 300 sec hold time | TNTC* |

*"TNTC" stands for "Too Numerous to Count"

TABLE 2

| Aerobic plate count readings measured in CFU/g for aqueous tobacco extract samples stored at 4° C. | | |
|---|---|---|
| Days After HPP | Product | APC (CFU/g) |
| 1 | Control (no HPP) | 2,400,000 |
| | HPP with 180 sec hold time | 120 |
| | HPP with 300 sec hold time | 20 |
| 25 | Control (no HPP) | 5,400,000 |
| | HPP with 180 sec hold time | 600,000 |
| | HPP with 300 sec hold time | 10 |
| 50 | Control (no HPP) | 3,300,000 |
| | HPP with 180 sec hold time | 1,400,000 |
| | HPP with 300 sec hold time | 450,000 |
| 75 | Control (no HPP) | 3,600,000 |
| | HPP with 180 sec hold time | 1,600,000 |
| | HPP with 300 sec hold time | 700,000 |
| 110 | Control (no HPP) | 33,000,000 |
| | HPP with 180 sec hold time | 29,000,000 |
| | HPP with 300 sec hold time | 14,000,000 |
| 150 | Control (no (no HPP) | 4,400,000 |
| | HPP with 180 sec hold time | 3,500,000 |
| | HPP with 300 sec hold time | 3,300,000 |

It is clear from the tables above that samples of aqueous tobacco extract subjected to an HPP treatment have an increased storage stability as compared to aqueous tobacco extract that has not undergone an HPP treatment process. It is noted that the data measured at 110 days may have been contaminated and therefore inaccurate.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of treating a tobacco material to enhance storage stability, comprising:

receiving a tobacco material having at least about 40% water based on the total weight;

adjusting the pH of the tobacco material to be in the range of about 4 to about 6;

sealing the tobacco material in a package and introducing the sealed tobacco material to a pressurizing medium;

subjecting the sealed tobacco material to a process pressure of at least about 30,000 psi by way of isostatic pressure transmitted by the pressurizing medium to form a high pressure processed tobacco material;

wherein the high pressure processed tobacco material has a first storage stability of at least about 25 days at a storage temperature of about 37° C., wherein the first storage stability is defined as an aerobic plate count below about 3,000,000 CFU/g.

2. The method of claim 1, wherein the processed tobacco material has a second storage stability of at least about 75 days at a storage temperature of about 4° C., wherein the second storage stability is defined as an aerobic plate count below about 3,000,000 CFU/g.

3. The method of claim 2, wherein the second storage stability is at least about 100 days.

4. The method of claim 1, wherein the tobacco material is in the form of a particulate material.

5. The method of claim 1, wherein the tobacco material is in the form of an aqueous tobacco extract.

6. The method of claim 1, wherein the process pressure is at least about 75,000 psi.

7. The method of claim 1, wherein the tobacco material is subjected to the process pressure for a holding time of at least about 30 seconds.

8. The method of claim 7, wherein the holding time is in the range of about 180 seconds to about 300 seconds.

9. The method of claim 1, further comprising incorporating the high pressure processed tobacco material into a tobacco product.

10. The method of claim 9, wherein the tobacco product is a smoking article.

11. The method of claim 9, wherein the tobacco product is a smokeless tobacco product.

* * * * *